US008127378B1

(12) United States Patent
Mintz

(10) Patent No.: US 8,127,378 B1
(45) Date of Patent: Mar. 6, 2012

(54) GUSSETED FOOT CANOPY FOR BED TOP SHEETS, BLANKETS, QUILTS OR BEDS AND THE LIKE

(76) Inventor: Harold P. Mintz, Fort Lee, NJ (US)

( * ) Notice: Subject to any disclaimer, the term of this patent is extended or adjusted under 35 U.S.C. 154(b) by 0 days.

(21) Appl. No.: 12/914,283

(22) Filed: Oct. 28, 2010

(51) Int. Cl.
*A47G 9/02* (2006.01)

(52) U.S. Cl. ..... 5/485; 5/486; 5/495

(58) Field of Classification Search ..... 5/486, 482, 5/485, 495, 497, 505.1, 506.1
See application file for complete search history.

(56) References Cited

U.S. PATENT DOCUMENTS

| | | | | | |
|---|---|---|---|---|---|
| 2,577,178 | A | * | 12/1951 | Bellinger | 5/485 |
| 2,679,056 | A | * | 5/1954 | Simpson | 5/485 |
| 2,695,414 | A | * | 11/1954 | Ford et al. | 5/485 |
| 2,772,425 | A | * | 12/1956 | Brodie | 5/485 |
| 2,788,532 | A | * | 4/1957 | Christley | 5/497 |
| 3,254,348 | A | * | 6/1966 | Di Addario | 5/499 |
| 3,377,636 | A | * | 4/1968 | Di Addario | 5/499 |
| 3,467,974 | A | * | 9/1969 | Deutsch | 5/502 |
| 3,654,646 | A | * | 4/1972 | McMahon, Jr. | 5/497 |
| 4,021,869 | A | * | 5/1977 | Root | 5/498 |
| 4,287,622 | A | * | 9/1981 | Lane | 5/505.1 |
| 4,308,626 | A | * | 1/1982 | Weiss | 5/485 |
| 4,841,589 | A | * | 6/1989 | Moore | 5/505.1 |
| 5,027,460 | A | * | 7/1991 | Honig | 5/497 |
| 5,042,098 | A | * | 8/1991 | Stultz | 5/495 |
| 5,084,929 | A | * | 2/1992 | Staudinger | 5/494 |
| 5,165,128 | A | * | 11/1992 | Honig | 5/497 |
| 5,177,821 | A | * | 1/1993 | Kawtoski | 5/497 |
| 5,189,744 | A | * | 3/1993 | Roberts | 5/497 |
| 5,884,349 | A | * | 3/1999 | Gretsinger | 5/502 |
| 5,970,543 | A | * | 10/1999 | Barreca et al. | 5/497 |
| 6,041,456 | A | * | 3/2000 | Pharr | 5/497 |
| 6,134,730 | A | * | 10/2000 | Evanson | 5/482 |
| 6,532,608 | B2 | * | 3/2003 | Schreiner | 5/497 |
| 6,725,477 | B2 | * | 4/2004 | Ciaglia et al. | 5/497 |
| 7,302,721 | B1 | * | 12/2007 | Dorr et al. | 5/497 |
| 7,380,297 | B2 | * | 6/2008 | Bauer | 5/497 |
| 2001/0032361 | A1 | * | 10/2001 | Schreiner | 5/497 |
| 2003/0037374 | A1 | * | 2/2003 | Ciaglia et al. | 5/497 |
| 2005/0273931 | A1 | * | 12/2005 | Edwards | 5/505.1 |
| 2007/0151028 | A1 | * | 7/2007 | Bauer | 5/482 |
| 2008/0295247 | A1 | * | 12/2008 | Rogers | 5/505.1 |

* cited by examiner

*Primary Examiner* — Robert G Santos
(74) *Attorney, Agent, or Firm* — Carlos R. Villamar; The Villamar Firm PLLC

(57) ABSTRACT

A bed top covering includes a top portion; and a bottom portion. The bottom portion includes a gusseted foot canopy therein configured to allow feet of a user to be extended in an upward direction therewithin and providing room and maneuverability for the feet of the user. A foot canopy for a bed, including top and side portions. The top and side portions form a gusseted foot canopy. The side portions are configured to be removable and attachable to a mattress of a bed. The gusseted foot canopy is configured to allow feet of a user to be extended in an upward direction therewithin and provides room and maneuverability for the feet of the user.

4 Claims, 3 Drawing Sheets

300

400

500

600

600

800

900

1000

GUSSETED FOOT CANOPY FOR BED TOP SHEETS, BLANKETS, QUILTS OR BEDS AND THE LIKE

BACKGROUND OF THE INVENTION

1. Field of the Invention

The present invention generally relates to bed top sheets, blankets, and quilts, and the like ("bed top coverings"), and more particularly to bed top coverings or beds having a gusseted foot canopy at the bottom thereof.

2. Discussion of the Background

Over the years, mass production has led to the standardization of international mattress sizes from crib/toddler to twin to double to queen to king and California king, and the like. Similarly, background art sheeting, blankets, and quilts also have been standardized in terms of lengths and widths. However, such background art sheeting, blankets, and quilts are not designed to allow for comfort for a user when the user is in a reclined position underneath the sheeting, blankets, or quilts with feet pointing upward and with the bed top coverings tucked in under the mattress.

SUMMARY OF THE INVENTION

Therefore, there is a need for bed top sheets, blankets, and quilts, and the like ("bed top coverings") or beds that overcome the deficiencies in the background art bed top coverings and beds and that are configured to allow for comfort for a user when the user is in a reclined position underneath the bed top coverings with feet pointing upward and with the bed top coverings tucked in under the mattress.

The above and other needs are addressed by exemplary embodiments of the present invention, which include improved bed top coverings or beds that incorporate a gusseted foot canopy at a bottom thereof. Advantageously, such bed top coverings or beds add ergonomics, pragmatics, and comfort to allow persons to recline in bed on their backs with their toes pointed toward the ceiling in far greater comfort than what is possible with background art bed coverings or beds. In addition, the exemplary gusseted foot canopy helps eliminate foot cramping, as the vast majority of people are unable to point their toes under the covers for an extended period of time, let alone point them upward at all, with background art bed coverings, especially when the background art bed coverings are in a "tucked in" position or state.

Accordingly, in an exemplary aspect there is provided a bed top covering including a top portion; and a bottom portion. The bottom portion including a gusseted foot canopy therein configured to allow feet of a user to be extended in an upward direction therewithin and providing room and maneuverability for the feet of the user.

The bed top covering can include one of a bed top sheet, a bed top blanket, and a bed top quilt. A top of the gusseted foot canopy can be one of rectangular shape, a dome shape, a round shape, a pointed shape, a roof shape. Sides of the gusseted foot canopy allow for expansion due to flexible material employed therein and can have an accordion type structure. The gusseted foot canopy can be configured as a vaulted foot-tent at the bottom portion of the bed top covering. The gusseted foot canopy can be made from a lighter more flexible material than the top portion of the bed top covering. The bed top covering can be configured to go over a bed mattress and tucked in around the bed mattress.

In a further exemplary aspect there is provided a foot canopy for a bed, including top and side portions. The top and side portion forming a gusseted foot canopy. The side portions being configured to be removable attachable to a mattress of a bed. The gusseted foot canopy configured to allow feet of a user to be extended in an upward direction therewithin and providing room and maneuverability for the feet of the user.

A top of the gusseted foot canopy can be one of rectangular shape, a dome shape, a round shape, a pointed shape, a roof shape. Sides of the gusseted foot canopy allow for expansion due to flexible material employed therein and can have an accordion type structure.

Still other aspects, features, and advantages of the present invention are readily apparent from the following detailed description, simply by illustrating a number of exemplary embodiments and implementations, including the best mode contemplated for carrying out the present invention. The present invention is also capable of other and different embodiments, and its several details can be modified in various respects, all without departing from the spirit and scope of the present invention. Accordingly, the drawings and descriptions are to be regarded as illustrative in nature, and not as restrictive.

BRIEF DESCRIPTION OF THE DRAWINGS

The embodiments of the present invention are illustrated by way of example, and not by way of limitation, in the figures of the accompanying drawings and in which like reference numerals refer to similar elements and in which.

DETAILED DESCRIPTION OF THE PREFERRED EMBODIMENTS

Figure 1:
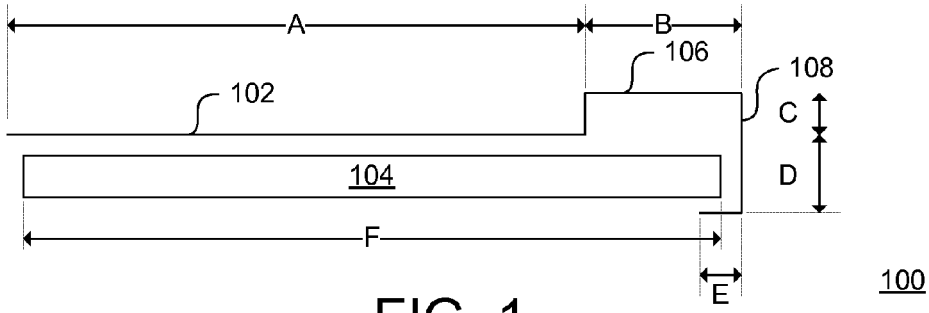
FIG. 1 illustrates a cut away, side view of an exemplary bed top covering with a gusseted foot canopy at a bottom thereof.

Generally, the present invention includes recognition that while beds and mattresses have evolved enormously, sheets and other bedding has not. The current state of bed sheet technology customarily includes a bottom sheet that is fitted with elastic to keep it from slipping off the mattress and a matching top sheet, basically a simple rectangular sheet of cloth, that is tucked in at the foot of the bed under the mattress to maintain neatness and enable the sleeper to be "tucked in" between the two comfortable (top and bottom) bed sheets. The bottom sheet is usually differentiated only by length and width; however, the top sheet generally has a distinct header and footer with the header of the sheet characterized by a wider, more decorative and/or monogrammed seam that is kept at the head of the bed with the sheet pattern facing downward so that when it is folded back to the foot of the bed (usually over a blanket or comforter), the design is exposed.

As our life styles have altered dramatically over the last half century, so too has the role of the bed. The bed has become far more than the province of sleeping and conjugality. With most bedrooms sporting flat-panel TVs and their occupants possessing laptops, iphones, ipads, droids, blackberries, kindles, etc., today's bed has become the locus of more and more informal and leisurely entertainment, reading, communication, and commerce. Many prefer to engage in these activities in bed just prior to calling it a night, first thing in the morning before they are willing to truly declare a start to the day, while not feeling well or incapacitated, or simply for comfort when there is inclement weather and/or a chill in the air. Thus, the person often prefers to have his or her lower body under the covers as the covers make the bed snuggly and offers protection from colder ambient air temperatures.

The present invention includes recognition of the problem that such a reclined position under the covers is not as comfortable as it ought to be, as it forces the individual's feet to point skyward and the room at the foot of the bed is insufficient to accommodate the foot's full extension. Moreover, as the top sheet and blankets are often tucked in 8-12" around the mattress and then another couple of inches underneath the end of the bed to keep things neat, tidy, and together, the taller the person is and/or the more tucked in he or she is the more the person's feet are subject to a nutcracker effect because they are situated in a veritable bed sheet fulcrum. It is actually for this reason that many people who prefer to sleep on their backs do so in a manner so that their feet are uncovered and free from the mechanical force (effort) of the cloth lever.

Therefore, the present invention includes recognition that there is a need for modernization of traditional bed top coverings so that a person may be tucked in under the covers in a reclined position on his or her back in far greater comfort than traditional bedding allows for.

Figure 2:
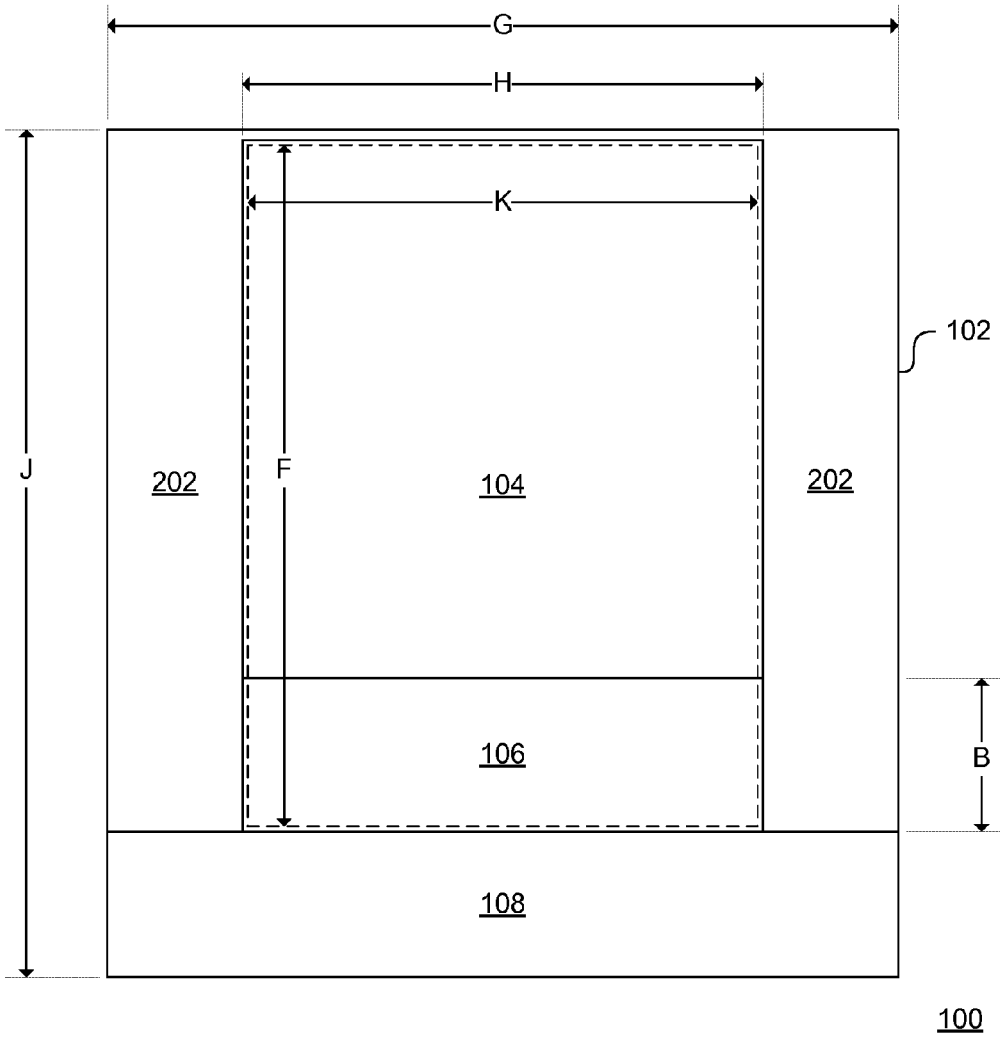
FIG. 2 illustrates a top view of the exemplary bed top covering of FIG. 1.

Referring now to the drawings, wherein like reference numerals designate identical or corresponding parts throughout the several views, and more particularly to FIGS. 1-5 thereof, there is illustrated exemplary bed top sheets, blankets, and quilts, and the like ("bed top coverings") with a gusseted foot canopy at a bottom thereof. In FIG. 1, the exemplary bed top covering system 100 is shown in a cut away view, and in FIG. 2, the exemplary bed top covering system 100 is shown in a top view. In FIGS. 1-2, the exemplary bed top covering system 100 can include a bed top covering 102 (e.g., made from any suitable material) over a mattress 104, with the bed top covering 102 including a gusseted foot canopy section 106, and a section 108 that can be tucked under the mattress 104.

The gusseted foot canopy section 106 can be of a rectangular shape, and configured as a vaulted foot-tent at the bottom portion of the bed top covering 102, as shown in FIGS. 1-2, and generally can be made from a lighter more flexible material than the rest of the bed top covering 102. Advantageously, the construction of the gusseted foot canopy 106 fosters room and maneuverability for the feet. The ceiling height "C" of the gusseted foot canopy 106 can be configured to be approximately a foot (e.g., 12") or so to accommodate larger feet. The gusseted foot canopy 106 can be made of a traditional sheet fabric or other materials, for example, including sail cloth, parachute material, and the like, that is lighter and fluffier than the rest of the bed top covering 102. Alternatively, the gusseted foot canopy 106 can have a roof that is of the same material at the bed top covering 102 but with side walls thereof that offer expandability. The gusseted foot canopy 106 can also accord warmth and breathability in relatively the same proportion as the bed top covering 102 it is part of. As an example, one would not likely make the gusseted foot canopy 106 out of heavy wool or fur for a light, summary, sheet, blanket, or quilt bed top covering 102. At the other extreme, one would not likely incorporate the gusseted foot canopy 106 out of fine or light silk for a heavier (e.g., flannel) winter sheet or blanket bed top covering 102.

Accordingly, in the example of FIGS. 1-2, the bed top covering 102 can be configured for a standard Queen sized mattress (e.g., 60"×80", dimensions "K"×"F"), can have about the same overall surface area as a standard top sheet for a Queen sized mattress (e.g., 90"×102", dimensions "G"× "J"), and can include the gusseted foot canopy 106 built-in for its ergonomic superiority. Accordingly, the gusseted foot canopy 106 for a Queen sized bed can be approximately 60" wide (dimensions "H") and 14" in width (dimensions "B") with the ceiling height of about 12" (dimensions "C"). Section 108 can include dimensions "D" and "E" that allow the top sheet with the gusseted foot canopy 106 to be tucked around and under the mattress 104 adding up, in the Queen sized bed example, to approximately 14" in total. The dimension marked "E" of the bed top covering 102 can be configured so as to be tucked under the mattress 104 and the dimension "A" can be approximately 74" or so for a Queen sized bed. As shown in FIG. 2, the bed top covering 102 can include side sections 202 that can lay along the side of the bed or that can be tucked in under the side of the mattress 104.

Figure 4:
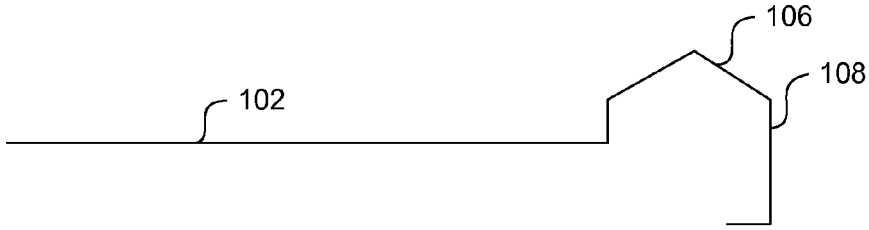
Figure 5:
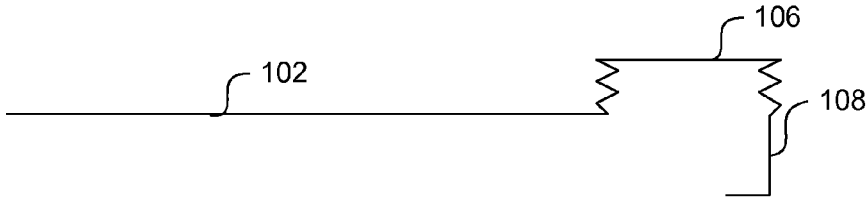

The gusseted foot canopy 106 construct can be varied with respect to shape, height, materials, construction, stitching techniques, and the like, based on the teachings of the present invention, as will be appreciated by those of ordinary skill in the relevant art(s). For example, FIGS. 3-5 illustrate further exemplary configurations of the gusseted foot canopy 106 of the bed top covering 102 FIGS. 1-2.

Figure 3:
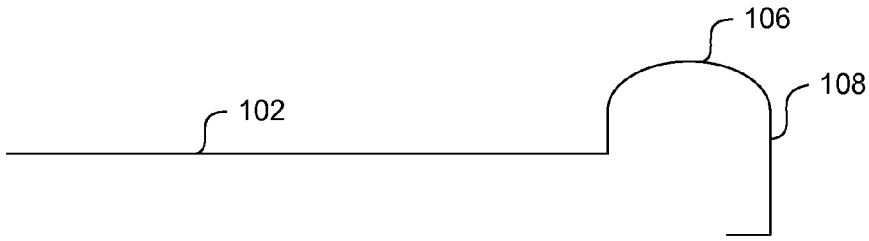
FIGS. 3-5 illustrate further exemplary configurations of the gusseted foot canopy of the bed top covering FIGS. 1-2.

In FIG. 3, the gusseted foot canopy 106 is shown as being configured to have a round or domed shape. In FIG. 4, the gusseted foot canopy 106 is shown as being configured to have a pointed or roof top shape. In FIG. 5, the gusseted foot canopy 106 is shown as being configured to have a flat top with accordion shaped sides, which can be included in the configurations of FIGS. 1-4 in further exemplary embodiments. Accordingly, the gusseted foot canopy 106 can be configured in any suitable shape, based on the teachings of the present invention, as will be appreciated by those of ordinary skill in the relevant art(s).

FIGS. 1-5 and the descriptions thereof are to be regarded as illustrative in nature, and not as restrictive as length, width, and height, so that the bed top covering 102 and the gusseted foot canopy 106 can be varied particularly depending upon bed size, and the like, based on the teachings of the present invention, as will be appreciated by those of ordinary skill in the relevant art(s). For example, the bed top covering 102 and the gusseted foot canopy 106 can be configured for the exemplary bed sizes and bed top covering types, as shown below:

Mattress Sizes: Twin—39×75 inches (or 99×190 cm); X-Long Twin—39×80 inches (99×203 cm), Full—54×75 inches (137×190 cm); Queen—60×80 inches (or 153×203 cm); King—76×80 inches (or 198×203 cm); California King—72×84 inches (or 182×213 cm).

Fitted Sheet Sizes: Twin—39×75 inches (or 99×190 cm); X-Long Twin—39×80 inches (99×203 cm); Full—54×75 inches (137×190 cm); Queen—60×80 inches (or 153×203 cm); King—76×80 inches (or 198×203 cm); California King—72×84 inches (or 182×213 cm).

Flat Sheet Sizes: Twin—66×96 inches (or 167×243 cm); X-Long Twin—66×102 inches (or 167×259 cm); Full—81× 96 inches (or 205×243 cm); Queen—90×102 inches (or 228× 259 cm); King/California King—108×102 inches (or 274× 259 cm).

Comforter Sizes: Twin—68×86 inches (or 173×218 cm); Full/Queen—86×86 inches (or 218×218 cm); King/California King—100×90 inches (or 254×229 cm).

Although the embodiments described with respect to FIGS. 1-5, are illustrated in terms of being applicable to bed top coverings, the beds themselves can be configured to include a foot canopy, based on the teachings of the present invention, as will be appreciated by those of ordinary skill in the relevant art(s).

Figure 6:
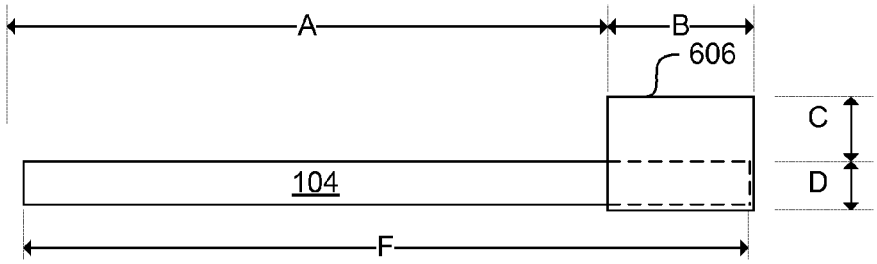
FIG. 6 illustrates a side view of an exemplary gusseted foot canopy for a bed.
Figure 7:
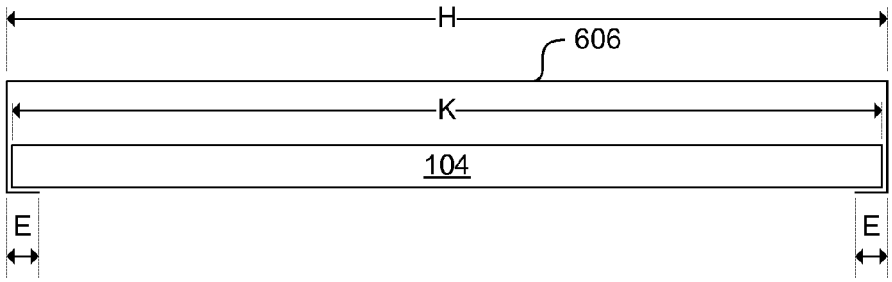
FIG. 7 illustrates a cross sectional width view of the gusseted foot canopy for a bed of FIG. 6.

Accordingly, FIGS. 6-10 illustrate an exemplary a gusseted foot canopy for a bed. The exemplary embodiments of the gusseted foot canopy for a bed of FIGS. 6-10 share many of the features and advantages previously described with respect to FIGS. 1-5 and common features, advantages, details, dimensions, and the like, will not be further described for the sake of brevity. In FIG. 6, the gusseted foot canopy system 600 is shown in a cut away view, and in FIG. 7, the gusseted foot canopy system 600 is shown in a cross sectional width view. In FIGS. 6-7, the exemplary gusseted foot canopy system 600 can include a gusseted foot canopy section 606 (e.g., made from any suitable material, such as plastic, cardboard, etc.) and adapted to be removably attached to a bottom portion of the mattress 104, with the gusseted foot canopy section 606 including a section shown with dimension "E" that can be tucked or snapped in under the mattress 104.

The gusseted foot canopy section 606 can be of a rectangular shape, and configured as a vaulted foot-tent at the bottom portion of the mattress 104, as shown in FIGS. 6-7. Advantageously, the construction of the gusseted foot canopy 606 fosters room and maneuverability for the feet. The ceiling height "C" of the gusseted foot canopy 606 can be configured to be approximately a foot (e.g., 12") or so to accommodate larger feet.

Figure 9:
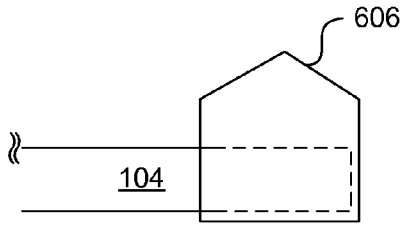
Figure 10:
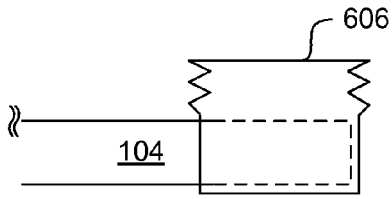

Accordingly, in the example of FIGS. 6-7, the gusseted foot canopy section 606 can be configured for a standard Queen sized mattress, as previously described with respect to FIGS. 1-5. The gusseted foot canopy 606 construct can be varied with respect to shape, height, materials, construction, stitching techniques, and the like, based on the teachings of the present invention, as will be appreciated by those of ordinary skill in the relevant art(s). For example, FIGS. 8-10 illustrate further exemplary configurations of the gusseted foot canopy 606 of FIGS. 6-7.

Figure 8:
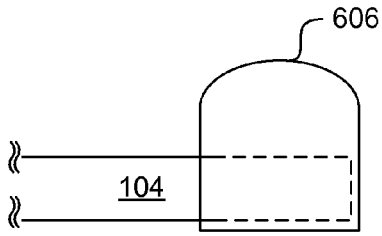
FIGS. 8-10 illustrate further exemplary configurations of the gusseted foot canopy for a bed of FIGS. 6-7.

In FIG. 8, the gusseted foot canopy 606 is shown as being configured to have a round or domed shape. In FIG. 9, the gusseted foot canopy 606 is shown as being configured to have a pointed or roof top shape. In FIG. 10, the gusseted foot canopy 606 is shown as being configured to have a flat top with accordion shaped sides, which can be included in the configurations of FIGS. 6-9 in further exemplary embodiments. Accordingly, the gusseted foot canopy 606 can be configured in any suitable shape, based on the teachings of the present invention, as will be appreciated by those of ordinary skill in the relevant art(s).

FIGS. 6-10 and the descriptions thereof are to be regarded as illustrative in nature, and not as restrictive as length, width, and height, so that the gusseted foot canopy 106 can be varied particularly depending upon bed size, and the like, based on the teachings of the present invention, as will be appreciated by those of ordinary skill in the relevant art(s). For example, the gusseted foot canopy 606 can be configured for the exemplary bed sizes and bed top covering types previously described with respect to FIGS. 1-5.

While the present invention has been described in connection with a number of exemplary embodiments and implementations, the present invention is not so limited but rather covers various modifications and equivalent arrangements, which fall within the purview of the appended claims.

What is claimed is:

1. A bed top covering, comprising:

a top portion; and a bottom portion, the bottom portion including a gusseted foot canopy therein configured to allow feet of a user to be extended in an upward direction therewithin and providing room and maneuverability for the feet of the user, wherein a top of the gusseted foot canopy is of a rectangular shape, the gusseted foot canopy has four sides attached to the top of the gusseted foot canopy, the sides of the gusseted foot canopy allow for expansion due to flexible material employed therein and have an accordion type structure, and the gusseted foot canopy is made from a lighter more flexible material than the top portion of the bed top covering or made from a heavier less flexible material than the top portion of the bed top covering.

2. The bed top covering of claim 1, wherein the bed top covering comprises one of a bed top sheet, a bed top blanket, and a bed top quilt.

3. The bed top covering of claim 1, wherein the gusseted foot canopy is configured as a vaulted foot-tent at the bottom portion of the bed top covering.

4. The bed top covering of claim 1, wherein the bed top covering is configured to go over a bed mattress and tucked in around the bed mattress.

* * * * *